US005388297A

United States Patent [19]

Ross

[11] Patent Number: 5,388,297

[45] Date of Patent: Feb. 14, 1995

[54] CONTAINER OPENING TOOL

[76] Inventor: Phillip N. Ross, 370 W. 5600 South, Washington Terrace, Utah 84405

[21] Appl. No.: 152,367

[22] Filed: Nov. 16, 1993

[51] Int. Cl.[6] ..... B67B 7/00

[52] U.S. Cl. ..... 7/156; 81/3.09

[58] Field of Search ..... 7/151, 156; 81/3.09

[56] References Cited

U.S. PATENT DOCUMENTS

| | | | |
|---|---|---|---|
| 2,702,652 | 2/1955 | Joyce | 7/156 |
| 2,729,125 | 1/1956 | Krzanowski | 7/151 X |
| 4,455,894 | 6/1984 | Roberts | 7/151 X |
| 4,723,465 | 2/1988 | Hughes | 81/3.09 |
| 4,835,860 | 6/1989 | Infeld | 7/151 X |

FOREIGN PATENT DOCUMENTS

| | | | |
|---|---|---|---|
| 17332 | of 1893 | United Kingdom | 7/156 |
| 223478 | 10/1924 | United Kingdom | 7/156 |

*Primary Examiner*—James G. Smith

[57] ABSTRACT

A container opening tool having a wrench end portion with at least one central opening therethrough and with each such opening having teeth spaced around the interior of the opening; a puncture and cut end portion and a handle interconnecting the wrench end and the puncture and cut end portion.

4 Claims, 2 Drawing Sheets

CONTAINER OPENING TOOL

BACKGROUND OF THE INVENTION

1. Field

This invention relates to household tools used to provide access to products packaged in commercial containers.

2. State of the Art

The desirability of household tools to provide easy access to products packaged in containers of various kinds and types has long been recognized.

Many devices have been proposed, for example, that will penetrate a container cap and that can then be used to pull the cap from the container. Such devices are shown, for example, in U.S. Pat. Nos. 790,192, 857,320, 1,142,427, and 1,386,056.

U.S. Pat. No. 5,054,338 discloses a tool that will operate along the rim of the container and when operated using a rocking and progressive motion will cut a lid from the container.

U.S. Pat. No. 4,455,894 discloses a multiple use tool that includes three distinctly different opening devices. One opening device comprises a centrally positioned socket-like portion to fit over twist-off bottle caps. Another opening device, at one end of the tool, comprises a wedge member insertable beneath a ring pull tab of a can and easy opening member. The third opening device is located at an opposite end and comprises a blade positioned between top and bottom flat surfaces forming a hook and with the blade extending across the hook. The third opening device is intended to be used in slitting plastic bags or the like.

U.S. Pat. No. 5,054,338 discloses a combination cap remover and carton top opener tool. As disclosed, the tool includes a twist-off cap remover, a bottle cap remover, and a carton top opener. The twist-off cap remover comprises a collar sized to fit over a twist-off cap. A pair of downwardly extending spaced apart tangs to engage and break a tamper proof zip strip placed around the cap. The bottle cap remover has a cover that fits over a bottle cap and a projecting tongue on the cover to engage a crimped edge of the bottle cap as the cap is lifted off the bottle. The carton top opener is a fork designed to be inserted into a carton top and lifted to break the seal. Such seals, if broken, prior to purchase of the goods indicate that tampering may have occurred with the product in the container, and serve as a warning to the consumer.

In recent years laws and regulations have been passed to require the use of tamper proof seals for the containers of many products. Such seals frequently of the barrier type use membranes of aluminum foil or plastic materials that are bonded to the container opening. Safety seals are now used on containers for vitamins, medicines and many foodstuffs. While, often such seals can be opened by most people with little effort it is difficult for people with physical disabilities and sometimes even for people without such disabilities to open containers having such seals. The seals are covered with a screw on top cover and this also is often difficult for a person with physical disabilities to remove.

SUMMARY OF THE INVENTION

The container opening tool of the present invention can be easily used, even by many persons with physical handicaps to remove a screw cap from a container and then to penetrate and remove a tamper proof seal of the barrier type provided over the opening to the container.

The present tool includes a wrench portion to fit over, tightly grip and twist-off a screw-type container cap and a puncture and cut portion to be used in the removal of a tamper proof seal of the barrier type.

The wrench portion of the tool will accommodate a range of cap sizes. The puncture and cut portion of the tool includes both a puncture end and a cutting blade made semi-sharp so that the tool can be safely used, even by children.

The tool is preferable made of one piece of injection molded plastic.

Additional objects and features of the tool of the invention will become apparent from the drawings and detailed description of the presently preferred embodiments.

THE DRAWINGS

In the drawings:

FIG. 1 is a front elevation view of a first embodiment of the tool of the invention, having a wrench portion with teeth formed interiorly of a circular cap-engaging ring;

FIG. 2, a side elevation view;

FIG. 3, a front elevation view of a second embodiment of the invention, having a wrench portion with teeth formed interiorly of an egg-shaped ring;

FIG. 4, a rear elevation view of the tool of FIG. 3; and

FIG. 5, a side elevation view of the tool of FIG. 3.

DETAILED DESCRIPTION

Figure 1:
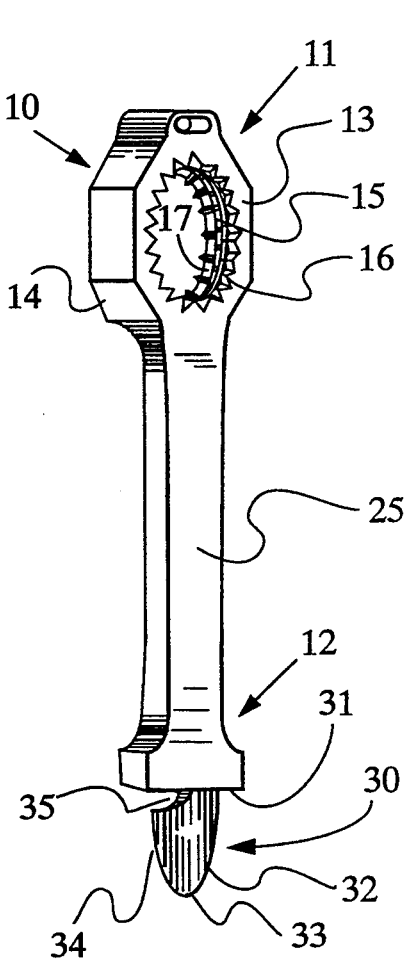
Figure 2:
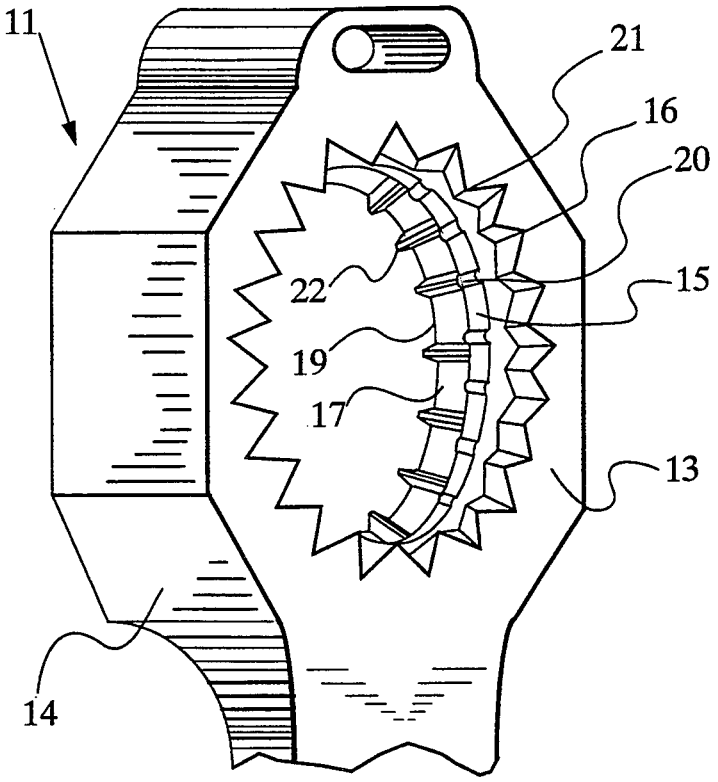

Referring now to the drawings:

In the illustrated embodiment of FIGS. 1 and 2, the tool of the invention is shown generally at 10. Tool 10 includes a wrench portion 11 and a puncture and cut portion 12.

Wrench portion 11 includes a body 13, which may have a hexagonal outer edge 14, a central bore 15 and enlarged counterbores 16 and 17 at opposite sides of the central bore 15. Central bore 15 interconnects to 17 and serves as a stop member.

Teeth 20, which are preferably closely spaced and oblong or rounded in configuration are formed on the inside of the circular bore 15. Similarly, triangular shaped teeth 21 are spaced, more closely than the teeth 20, around the interior of counterbore 16.

Teeth 22 are of polygonal configuration and are more widely spaced apart than are the teeth 20 and 21.

The central bore 15 and counterbores 16 and 17, with the different teeth arrangements, fit over different sizes and kinds of threaded caps to grip the caps as the tool 10 is turned and the cap is removed from a container.

An intermediate length 25 of the tool 10 interconnects the wrench portion 11 and a puncture and cut portion 12. The intermediate length 25 is sufficiently long that a user can grasp it as a handle while using either the wrench portion 11 or the puncture and cut portion 12 of the tool.

The puncture and cut portion 12 of tool 10 comprises a blade 30 projecting from intermediate length 25. Shoulder 31 is formed at the junction of the intermediate length 25 and the blade.

Blade 30 has a back edge 32 curved from the intermediate length to a penetrating point 33. A forward edge 34 has a curved notch 35 and both the forward edge and the curved notch are made semi-sharp so they will cut seal material initially punctured by the point. In use, the shoulder 31 rests on the rim of the container opening and the tool is pulled around the rim. The sharpened edge of the notch is angled such that the cut material is directed upwardly and inwardly away from the container edge such that it can be easily grasped for removal.

The intermediate length 25 of the tool 10 serves as a handle during puncturing and cutting of the protective seal.

Figure 3:
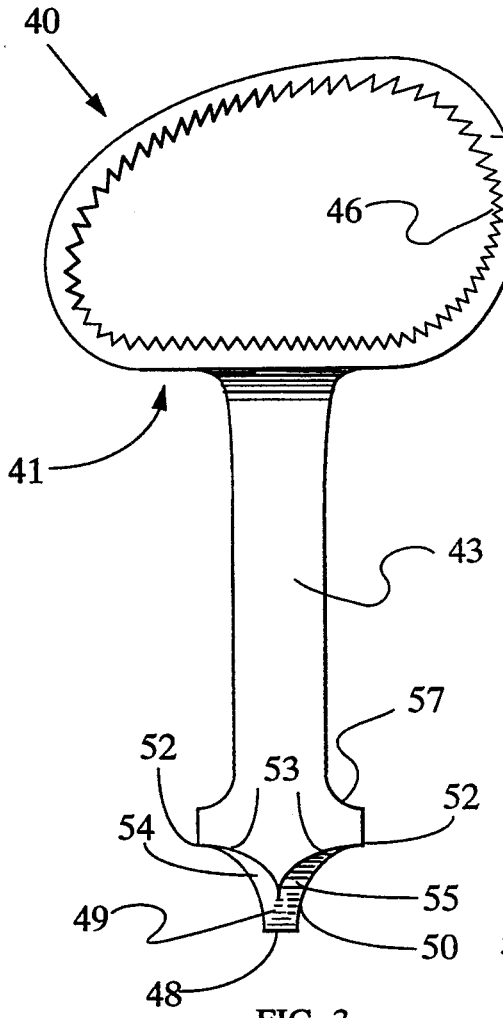
Figure 4:
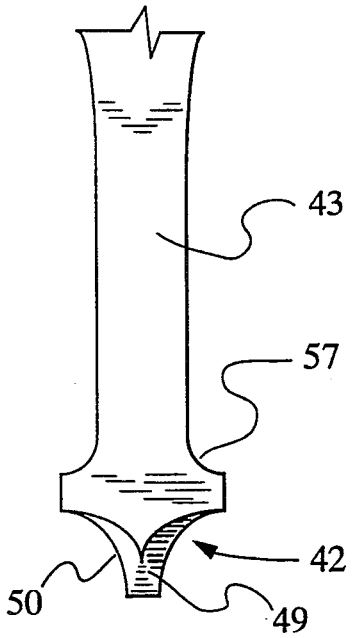
Figure 5:
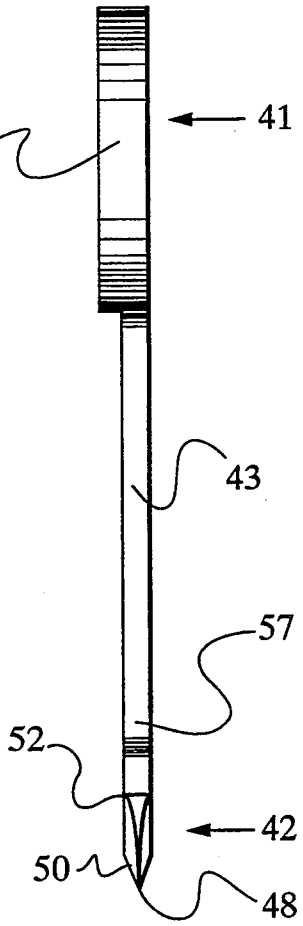

In the embodiment of the invention shown in FIGS. 3–5, the container opening tool, shown generally at 40 includes a wrench portion 41 and a puncture and cut portion 42. The wrench portion 41 and the puncture and cut portion 42 are interconnected by an intermediate portion that serves as a handle 43.

Wrench portion 41 has a generally egg-shaped flat ring 45 with teeth 46 formed on the interior surface of the ring. Large caps to be removed from containers are positioned in the large end of the ring to be engaged by the teeth. Smaller caps are engaged by the small end of the ring.

The puncture and cut portion 42 includes a central puncture blade 48 and a pair of cutting blades 49 and 50 that each curve upwardly and outwardly from the puncture blade to an outermost end 52 of a curved shoulder 57. The sides of the cutting blades 49 and 50 also each curve upwardly and outwardly to form the curved shoulder 57.

Although a preferred form of my invention has been herein disclosed, it is to be understood that the present disclosure is by way of example and that variations are possible without departing from the subject matter coming within the scope of the following claims, which subject matter I regard as my invention.

I claim:

1. A container opening tool comprising a wrench end portion having at least one central opening having teeth spaced around the interior of said opening;

a puncture and cut portion including an end sufficiently pointed to puncture a container surface, a curved rim engaging shoulder and a curved blade interconnecting said pointed end and said shoulder; and a handle interconnecting said wrench end portion and said puncture and cut portion.

2. A container opening tool as in claim 1, wherein each opening is egg shaped.

3. A container opening tool comprising a wrench end portion having a plurality of central openings and having teeth spaced around the interior of each said opening said openings surrounding a common central axis and each having a different cross-sectional area and extending partially through said wrench end portion;

a puncture and cut portion including an end sufficiently pointed to puncture a container surface, a rim engaging shoulder and a blade interconnecting said pointed end and said shoulder; and a handle interconnecting said wrench end portion and said puncture and cut portion.

4. A container opening tool as in claim 3, wherein the wrench end portion has three said openings.

* * * * *